US008032992B2

(12) United States Patent
Willour

(10) Patent No.: US 8,032,992 B2
(45) Date of Patent: Oct. 11, 2011

(54) CORSAGE PIN WITH TWO BENDABLE PINS

(76) Inventor: Brenda Willour, Harrisonville, MO (US)

( * ) Notice: Subject to any disclaimer, the term of this patent is extended or adjusted under 35 U.S.C. 154(b) by 700 days.

(21) Appl. No.: 12/143,633

(22) Filed: Jun. 20, 2008

(65) Prior Publication Data

US 2009/0000081 A1 Jan. 1, 2009

Related U.S. Application Data

(60) Provisional application No. 60/937,710, filed on Jun. 29, 2007.

(51) Int. Cl.
*A45F 5/08* (2006.01)

(52) U.S. Cl. ..... 24/6; 24/5; 47/41.15

(58) Field of Classification Search ..... None
See application file for complete search history.

(56) References Cited

U.S. PATENT DOCUMENTS

| | | | | | |
|---|---|---|---|---|---|
| 174,364 | A | * | 3/1876 | Hurdle | 24/6 |
| 348,332 | A | * | 8/1886 | McLane | 24/6 |
| 508,149 | A | | 11/1893 | Schumm | |
| 532,587 | A | * | 1/1895 | Schill | 29/10 |
| 547,181 | A | * | 10/1895 | Park | 24/6 |
| 596,221 | A | | 12/1897 | Sturtevant | |
| 693,150 | A | | 2/1902 | Potter | |
| 755,856 | A | * | 3/1904 | Dover | 63/20 |
| 755,857 | A | * | 3/1904 | Dover | 63/20 |
| 796,151 | A | * | 8/1905 | Sadler | 63/20 |
| 1,007,081 | A | * | 10/1911 | Fehrm | 24/710.5 |
| 1,067,150 | A | | 7/1913 | Shellhammer | |
| 1,372,820 | A | | 3/1921 | Kern | |
| 2,173,011 | A | * | 9/1939 | De Meester | 24/5 |
| 2,700,806 | A | * | 2/1955 | Fleischer | 24/360 |
| 2,787,819 | A | * | 4/1957 | Kaber | 24/5 |
| 3,142,100 | A | * | 7/1964 | Shoemaker | 24/5 |
| 3,735,447 | A | * | 5/1973 | Abraham | 24/6 |
| 4,229,877 | A | * | 10/1980 | Fagan | 29/509 |
| 4,477,946 | A | * | 10/1984 | Mafli | 24/5 |
| 4,559,675 | A | * | 12/1985 | Devenny | 24/5 |
| 4,852,220 | A | * | 8/1989 | Berardi | 24/6 |
| D334,905 | S | * | 4/1993 | Ritz | D11/43 |
| 5,836,017 | A | * | 11/1998 | Hironaga et al. | 2/69 |
| 6,715,184 | B1 | * | 4/2004 | Droschak | 24/5 |
| D550,121 | S | * | 9/2007 | Minneci | D11/200 |
| 2007/0101643 | A1 | * | 5/2007 | Yowney et al. | 47/41.15 |

* cited by examiner

*Primary Examiner* — Jack W. Lavinder
(74) *Attorney, Agent, or Firm* — Kenneth L. Green

(57) ABSTRACT

A corsage pin and method for constructing a corsage facilitate attachment of a corsage to the corsage pin. The corsage pin includes a medal with a bendable and cutable post attached to the back of the medal and extending down. The corsage is positioned in front of the corsage pin, and the post is cut to a length approximately one inch below the lowest stem of the corsage, and then bent approximately 180 degrees. The stem(s) of the corsage are positioned to overlap the end of the bent post and tape is wrapped around the post and corsage. Two horizontally spaced apart pins on the back of the medal are inserted through a garment and bent 90 degrees to affix the corsage to the garment.

4 Claims, 4 Drawing Sheets

CORSAGE PIN WITH TWO BENDABLE PINS

The present application claims the priority of U.S. Provisional Patent Application Ser. No. 60/937,710 filed Jun. 29, 2007, which application is incorporated in its entirety herein by reference.

BACKGROUND OF THE INVENTION

The present invention relates to corsage pins and in particular to a corsage pin with a bendable metal post for attaching flowers and a pair of bendable prongs for attaching the corsage pin to a garment.

Corsage pins are commonly used to attach corsages to garments. Unfortunately, known corsage pins often do not facilitate a simple convenient method for attaching a corsage to the corsage pin.

BRIEF SUMMARY OF THE INVENTION

The present invention addresses the above and other needs by providing a corsage pin and a method for constructing a corsage facilitate attachment of a corsage to the corsage pin. The corsage pin includes a medal with a bendable and cutable post attached to the back of the medal and extending down. The corsage is positioned in front of the corsage pin, and the post is cut to a length approximately one inch below the lowest point of the corsage, and then bent approximately 180 degrees. A stem from the corsage is pushed over the end of the bent post and tape is wrapped around the post and corsage. Two horizontally spaced apart pins on the back of the medal are inserted through a garment and bent 90 degrees to affix the corsage to the garment.

In accordance with one aspect of the invention, there is provided a method for constructing and wearing a corsage. The method includes positioning a corsage at a desired position on a corsage pin in front of a corsage pin post extending down from the back of a medal of the corsage pin, comparing corsage length to the post and cutting the post about one inch below the corsage, bending the post about 180 degrees about one inch above the lower end of the post, positioning a stem(s) of the corsage beside the bent portion of the post, taping the corsage to the post to construct the corsage and pin, positioning the corsage and pin at a desired position on a garment, pressing a pair of horizontally spaced apart pins attached to the rear of the medal through a wearer's garment, and bending the pins to retain the corsage and pin on the garment.

In accordance with another aspect of the invention, there is provided a corsage pin including a medal, a corsage post, and a pair of horizontally spaced apart bendable garment pins. The medal has a face and a back, with a clear coating over the face of the medal, and a writing on the face of the medal visible through the clear coating. The corsage post is attached to the back of the medal and extends down from the medal approximately six inches, and is both cutable and bendable. The garment pins are attached to the back of the medal and extend back approximately 0.8 inches.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figures 1, 2:
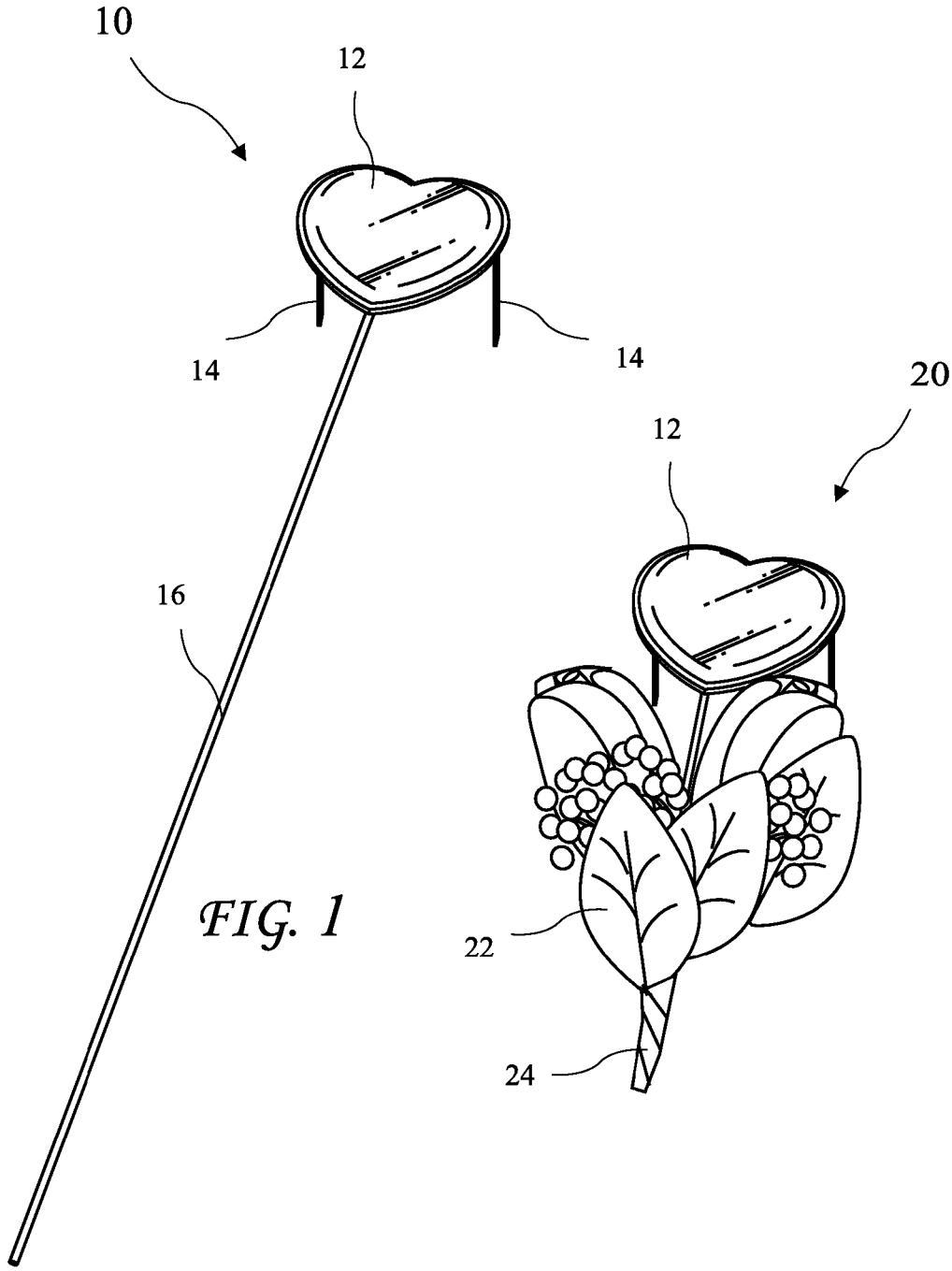
FIG. 1 is a perspective view of a corsage pin according to the present invention.
FIG. 2 is a perspective view of a corsage including the corsage pin with a corsage attached.

A perspective view of a corsage pin 10 according to the present invention is shown in FIG. 1. The corsage pin 10 includes a heart shaped medal 12, a pair of horizontally spaced apart garment pins 14 attached to a rear surface 10*b* (see FIG. 3B) of the medal 12, and a corsage post 16 attached to a rear surface 10*b* of the medal 12 and extending down from the medal 12.

A perspective view of a corsage and pin 20 constructed from the corsage pin 10 with a corsage 22 attached is shown in FIG. 2. The corsage post 16 is cut and bent during construction of the corsage and pin 20.

Figures 3A, 3B, 3C, 3D:
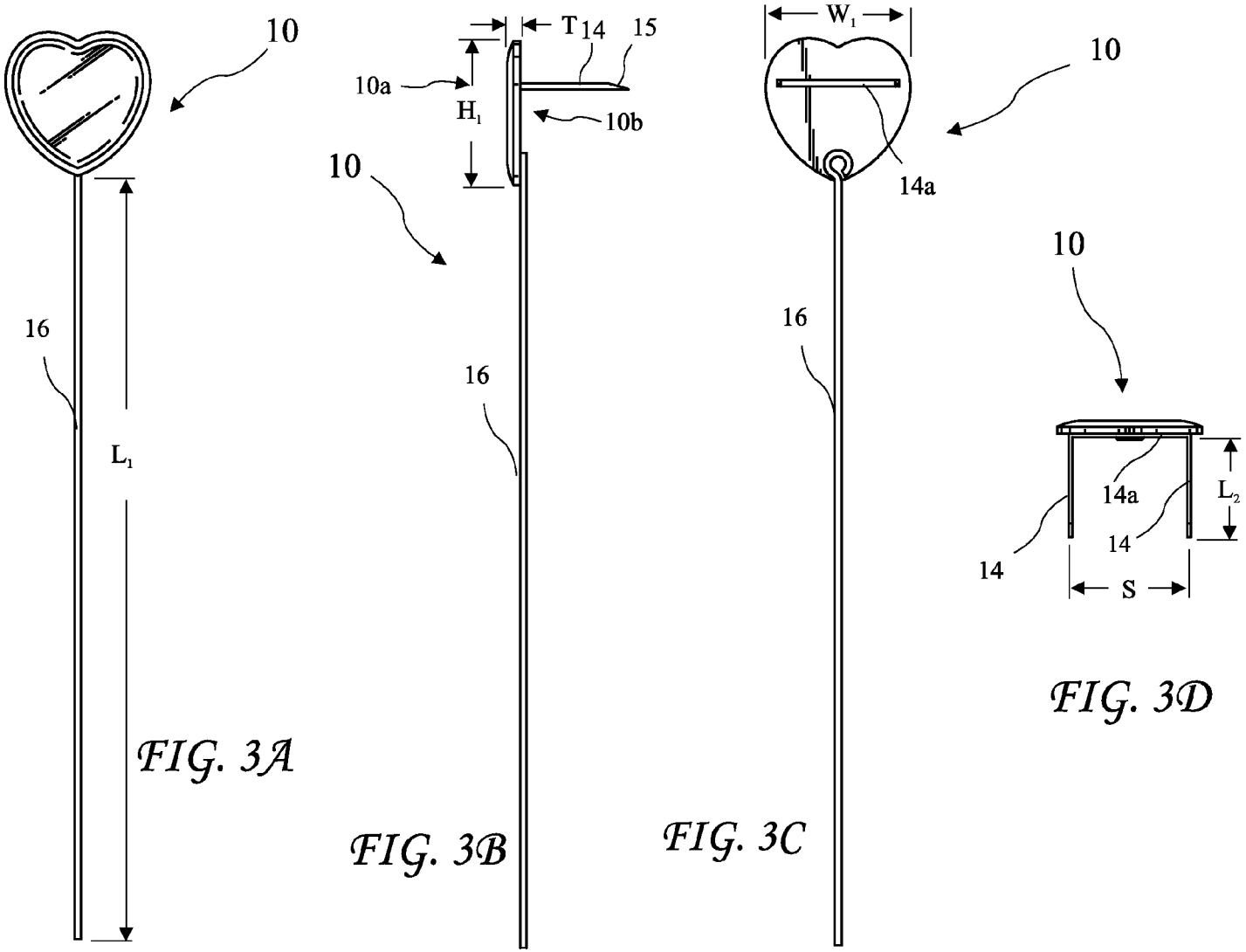
FIG. 3A is a front view of the corsage pin according to the present invention.
FIG. 3B is a side view of the corsage pin according to the present invention.
FIG. 3C is a rear view of the corsage pin according to the present invention.
FIG. 3D is a top view of the corsage pin according to the present invention.

A front view of the corsage pin 10 is shown in FIG. 3A, a side view of the corsage pin 10 is shown in FIG. 3B, a rear view of the corsage pin 10 is shown in FIG. 3C, and a top view of the corsage pin 10 is shown in FIG. 3D. The corsage post 16 has a length L1. The length L1 is preferably between approximately four and approximately eight inches, and is more preferably approximately six inches. The corsage post 16 is both easily cutable and easily bendable. The corsage post 16 is preferably metal and an example of a suitable material for the corsage post 16 is preferably approximately 0.04 inches in diameter.

The medal 12 has a height $H_1$, a width $W_1$, and a thickness T. The height $H_1$ is preferably approximately one inch, the width $W_1$ is preferably approximately one inch, and the thickness $T_1$ is preferably approximately 0.1 inches. The thickness $T_1$ of the medal 12 preferably includes a clear layer 30 (see FIG. 4A), which, for example, may be a clear epoxy.

The garment pins 14 extend a length $L_2$ from the rear surface 10*b* (see FIG. 3B) and are horizontally spaced apart by a spacing S. The length $L_2$ is preferably between approximately ⅜ inches and approximately ⅞ inches and is more preferably approximately 0.8 inches, and the spacing S is preferably approximately 0.8 inches. The garment pins 14 are preferably part of a single piece with a back 14*a* attached to the rear surface 10*b*. The garment pins 14 further preferably have a cross-section between approximately 0.02 inches and approximately 0.04 inches and more preferably have a rectangular cross-section with dimensions of approximately 0.02 inches by approximately 0.04 inches. The ends of the garment pins 14 preferably include points 15 (see FIG. 15B) to facilitate penetrating a garment.

Figure 4A:
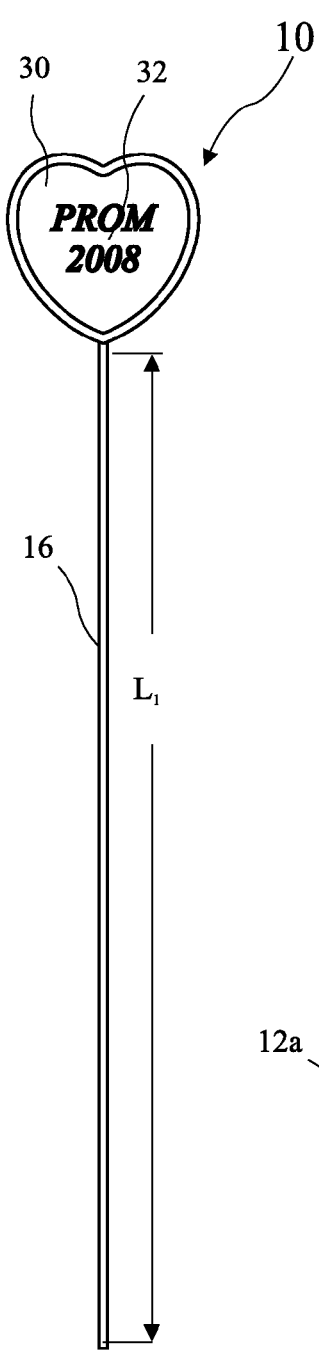
FIG. 4A is a front view of the corsage pin with a full length corsage post according to the present invention.
Figure 4B:
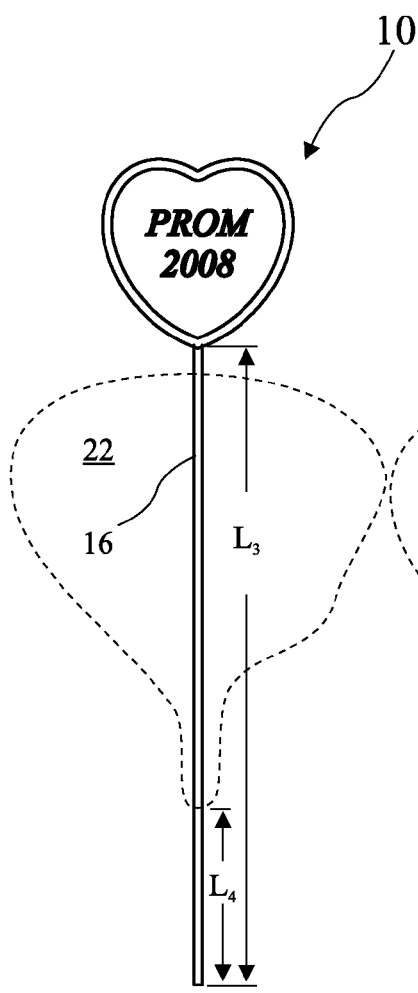
FIG. 4B is a front view of the corsage pin with the corsage post cut to a shorter length.
Figure 4C:
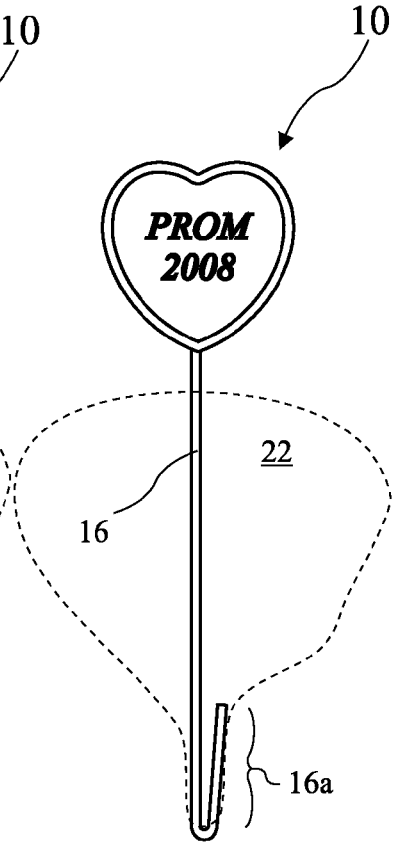
FIG. 4C is a front view of the corsage pin with the corsage post cut to a shorter length and bent approximately 180 degrees.

A front view of the corsage pin 10 with an un-cut corsage post 16 is shown in FIG. 4A, a front view of the corsage pin 10 with the corsage post 16 cut to a shorter length is shown in FIG. 4B, and a front view of the corsage pin 10 with the corsage post 16 cut to the shorter length and bent approximately 180 degrees is shown in FIG. 4C. The corsage pin 10 is provided with a long corsage post 16 to allow the corsage post to be cut to the proper length. Preferably, the corsage 22 (shown in dashed lines here) is held in a desired position with respect to the corsage pin 10, and the corsage post 16 is cut at a length $L_4$ longer than the corsage. The length $L_4$ is preferably approximately one inch below the bottom of the corsage 22. The corsage post 16 is then bent approximately 180 degrees resulting in a bent portion 16*a* of the corsage post 16 overlapping the lowermost portion of the corsage 22, which is generally one or more stems of the corsage 22. Later, as described in the method of FIG. 7, a stem(s) of the corsage 22 is positioned beside the bent portion 16*a* as part of constructing the corsage and pin 20.

A writing 32 may be provided on the face 10*a* of the medal 12. The writing may be under the clear layer 30 or on the clear layer 30. The writing 32 may be, for example, an anniversary, a reunion, or any event where a corsage is worn.

Figure 5:
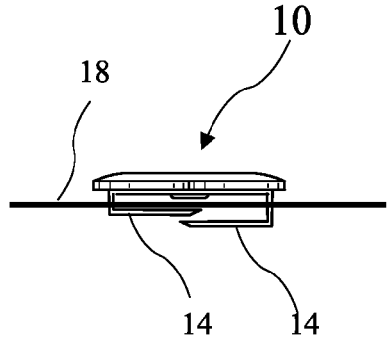
FIG. 5 is a top view of the corsage pin with garment pins inserted through a garment and folded approximately 90 degrees to retain the corsage pin on the garment.

A top view of the corsage pin 10 with garment pins 14 inserted through a garment 18 and folded approximately 90 degrees to retain the corsage pin 10 on the garment 18 is shown in FIG. 5. The size and pointed ends 15 (see FIG. 3B) of the garment pins 14 allow the garment pins 14 to be inserted through a garment 18 without damaging the garment. While rectangular garment pins 14 are disclosed above, garment pins with any cross-section, for example, round, oval, elliptical, hexagonal, etc., are intended to come within the scope of the present invention.

Figure 6:
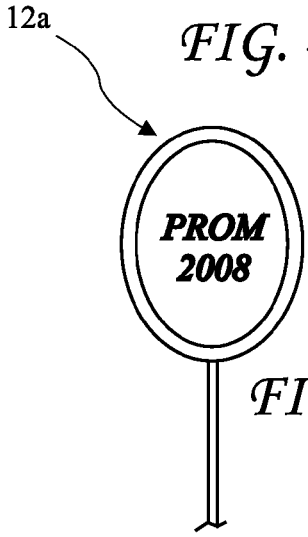
FIG. 6 is an embodiment of the present invention having an oval shaped medal.

A corsage pin with an oval medal 12*a* is shown in FIG. 6. The oval medal 12*a* has approximately the same width W1 (see FIG. 3C) as the heart shaped medal 12, and is otherwise similar to the heart shaped medal 12. While a heart shape and an oval shape are preferred, a corsage pin with any shape medal and otherwise similar to the corsage pin described above is intended to come within the scope of the present invention.

Figure 7:
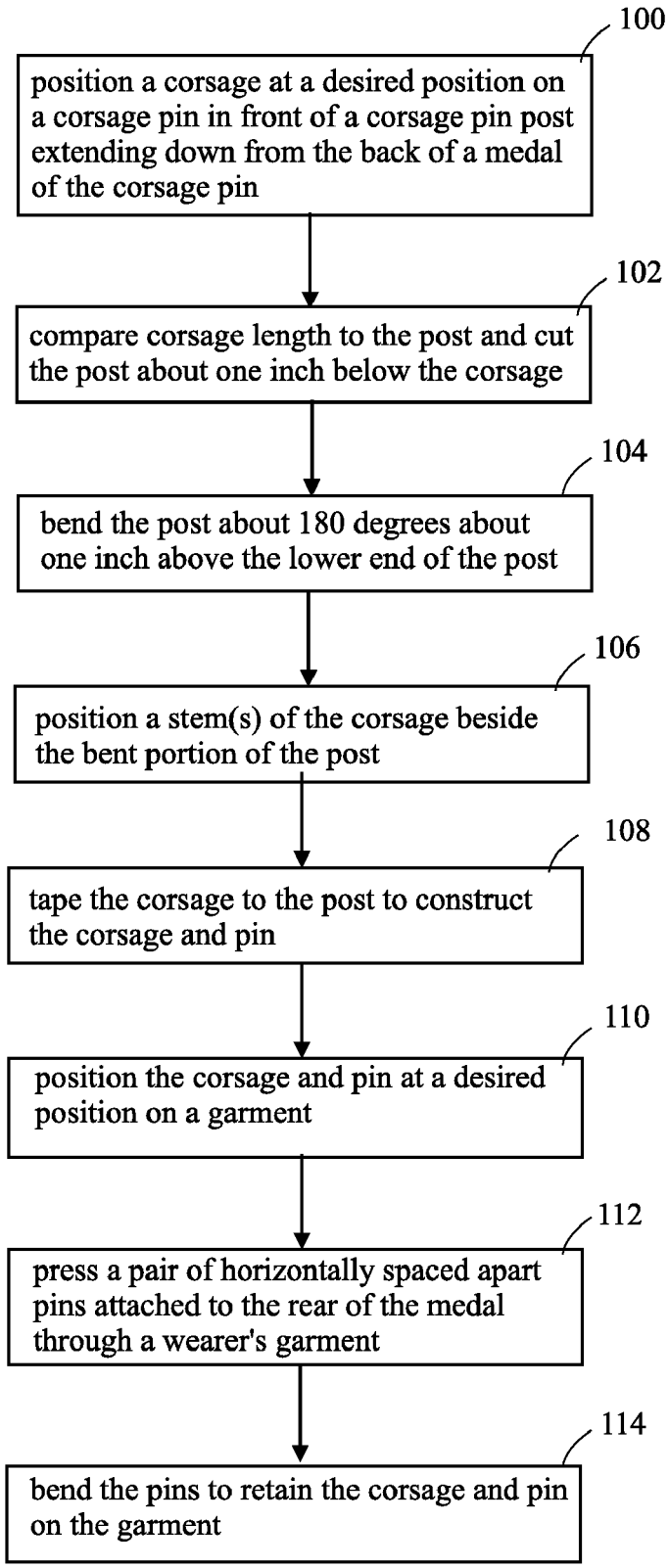
FIG. 7 is a method according to the present invention for preparing and wearing the corsage pin.

A method according to the present invention for preparing and wearing the corsage pin is described in FIG. 7. The method includes positioning a corsage at a desired position on a corsage pin in front of a corsage pin post extending down from the back of a medal of the corsage pin at step 100, comparing corsage length to the post and cut the post about one inch below the corsage at step 102, bending the post about 180 degrees about one inch above the lower end of the post at step 104, positioning a stem(s) of the corsage beside the bent portion of the post at step 106, taping the corsage to the post to construct the corsage and pin at step 108, positioning the corsage and pin at a desired position on a garment at step 110, pressing a pair of horizontally spaced apart pins attached to the rear of the medal through a wearer's garment at step 112, and bending the pins to retain the corsage and pin on the garment at step 114.

The corsage pin 10 described above may further be embodied as a boutonniere and a boutonniere including the post and pins described above is intended to come within the scope of the present invention. For the purposes of the present invention, the names corsage and boutonniere are considered equivalent.

While the invention herein disclosed has been described by means of specific embodiments and applications thereof, numerous modifications and variations could be made thereto by those skilled in the art without departing from the scope of the invention set forth in the claims.

I claim:

1. A method for constructing and wearing a corsage, the method comprising:

positioning a corsage at a desired position on a corsage pin in front of a corsage pin post extending down from a back of a medal of the corsage pin;

comparing corsage length to the post and cutting the post about one inch below the corsage;

bending the post about 180 degrees about one inch above the lower end of the post;

positioning at least one stem of the corsage beside the bent portion of the post;

taping the corsage to the post to construct the corsage and pin;

positioning the corsage and pin at a desired position on a garment;

pressing a pair of horizontally spaced apart pins attached to the rear of the medal through a wearer's garment; and bending the pins to retain the corsage and pin on the garment.

2. A method for constructing and wearing a corsage and pin, the method comprising:

positioning a corsage at a desired position on a corsage post, the corsage post attached to a back of a medal and extending down from the back of the medal between approximately four inches and approximately eight inches;

comparing corsage length to the corsage post and cutting the corsage post about one inch below the corsage;

bending the corsage post about 180 degrees about one inch above the lower end of the corsage post;

positioning at least one stem of the corsage against the bent portion of the corsage post;

taping the corsage to the corsage post to construct the corsage and pin;

positioning the corsage and pin at a desired position on a garment;

pressing a pair of horizontally spaced apart garment pins attached to the rear of the medal through a wearer's garment; and bending the garment pins to retain the corsage and pin on the garment.

3. The method of claim 2, where the corsage post is about six inches long.

4. A method for constructing and wearing a corsage and pin, the method comprising:

positioning a corsage at a desired position on a corsage post, the corsage post attached to a back of a medal and extending down from the back of the medal;

comparing corsage length to the corsage post and cutting the corsage post about one inch below the corsage;

bending the corsage post about 180 degrees about one inch above the lower end of the corsage post;

positioning at least one stem of the corsage against the bent portion of the corsage post;

taping the corsage to the corsage post to construct the corsage and pin;

positioning the corsage and pin at a desired position on a garment;

pressing a pair of horizontally spaced apart garment pins attached to the rear of the medal through a wearer's garment, the garment pins about 0.8 inches long; and bending the garment pins to retain the corsage and pin on the garment.

* * * * *